US011401761B2

(12) United States Patent
Flores Perez et al.

(10) Patent No.: US 11,401,761 B2
(45) Date of Patent: Aug. 2, 2022

(54) PLUG SETTING TOOL

(71) Applicants: Juan Carlos Flores Perez, The Woodlands, TX (US); YingQing Xu, Tomball, TX (US)

(72) Inventors: Juan Carlos Flores Perez, The Woodlands, TX (US); YingQing Xu, Tomball, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/800,825

(22) Filed: Feb. 25, 2020

(65) Prior Publication Data

US 2021/0262302 A1 Aug. 26, 2021

(51) Int. Cl.

*E21B 23/04* (2006.01)
*E21B 23/01* (2006.01)
(Continued)

(52) U.S. Cl.

CPC ..... *E21B 23/0417* (2020.05); *E21B 23/01* (2013.01); *E21B 23/04* (2013.01); *E21B 23/0411* (2020.05); *E21B 23/06* (2013.01); *E21B 23/065* (2013.01); *E21B 33/128* (2013.01); *E21B 33/1293* (2013.01); *E21B 34/06* (2013.01); *E21B 47/002* (2020.05); *E21B 47/06* (2013.01); *E21B 47/07* (2020.05); *E21B 47/09* (2013.01); *E21B 47/12* (2013.01); *E21B 2200/05* (2020.05)

(58) Field of Classification Search

CPC ..... E21B 17/02; E21B 17/06; E21B 17/046; E21B 23/00; E21B 23/01; E21B 23/04; E21B 23/0411; E21B 23/0417; E21B 23/06

See application file for complete search history.

(56) References Cited

U.S. PATENT DOCUMENTS 3,303,884 A 2/1967 Medford, Jr.
5,211,224 A 5/1993 Bouldin
(Continued)

FOREIGN PATENT DOCUMENTS

WO 2016161379 A1 10/2016

OTHER PUBLICATIONS

International Search Report and Written Opinion, PCT/US2021/019383; Korean Intellectual Property Office; dated May 26, 2021; 7 pages.

*Primary Examiner* — Tara Schimpf
(74) *Attorney, Agent, or Firm* — Cantor Colburn LLP

(57) ABSTRACT

An apparatus for setting a plug in a borehole penetrating a subsurface formation includes a tool mandrel defining a chamber having a port and a power charge disposed in the chamber for emitting a pressurized gas upon ignition. The apparatus also includes an outer sleeve at least partially surrounding the tool mandrel and defining an annulus between the outer sleeve and the tool mandrel where the annulus is in communication with the port. The apparatus further includes a piston disposed in the annulus and having an outer surface facing uphole within the annulus, the piston being in mechanical communication with a setting sleeve of the plug, wherein displacement of the setting sleeve causes setting of a slip and a seal of the plug.

20 Claims, 6 Drawing Sheets

(51) Int. Cl.

| | |
|---|---|
| ***E21B 23/06*** | (2006.01) |
| ***E21B 33/128*** | (2006.01) |
| ***E21B 33/129*** | (2006.01) |
| ***E21B 34/06*** | (2006.01) |
| *E21B 47/12* | (2012.01) |
| *E21B 47/07* | (2012.01) |
| *E21B 47/002* | (2012.01) |
| *E21B 47/06* | (2012.01) |
| *E21B 47/09* | (2012.01) |

(56) References Cited

U.S. PATENT DOCUMENTS

| | | | | |
|---|---|---|---|---|
| 7,017,672 | B2 * | 3/2006 | Owen, Sr. | E21B 23/06 166/123 |
| 9,810,035 | B1 * | 11/2017 | Carr | E21B 23/065 |
| 10,443,331 | B1 * | 10/2019 | Andres | E21B 33/1293 |
| 10,781,651 | B2 * | 9/2020 | Hern | E21B 23/065 |
| 10,927,627 | B2 * | 2/2021 | Eitschberger | E21B 23/06 |
| 2018/0306001 | A1 * | 10/2018 | Themig | E21B 43/14 |
| 2019/0178045 | A1 | 6/2019 | Frazier et al. | |
| 2020/0018132 | A1 * | 1/2020 | Ham | E21B 23/06 |
| 2020/0131880 | A1 * | 4/2020 | Macrae | E21B 33/128 |
| 2020/0378731 | A1 * | 12/2020 | McNelis | E21B 41/0085 |

* cited by examiner

PLUG SETTING TOOL

BACKGROUND

Boreholes or wellbores drilled into geologic subsurface formations for the extraction of hydrocarbons are typically lined with a casing or tubing. The casing for example prevents the formation wall from caving into the borehole and isolates different formation zones to prevent the flow or crossflow of formation fluids.

In certain situations, hydrocarbons will not readily flow into a wellbore from a formation due to the type of formation rock. In these situations, the formation will have to be stimulated such as by hydraulic fracturing to increase the flow. Because wellbores can be thousands of meters long, the formations are typically fractured along specific lengths of the wellbores referred to as stages. In order to isolate one stage from an adjacent stage so that only the stage of interest is fractured, a fracture plug or "frac plug" is installed in the casing between the adjacent stages. Installation of a frac plug generally requires an installation tool along with the frac plug be run into the wellbore. The installation tool then sets the frac plug in place at a desired location. With wellbores being thousands of meters long, many stages may be required to adequately fracture the formation with the corresponding use and expense of required installation tools. Hence, it would be well received in the hydrocarbon production industry if frac plug setting tools were developed that lowered the cost of installing frac plugs.

BRIEF SUMMARY

Disclosed is an apparatus for setting a plug in a borehole penetrating a subsurface formation. The apparatus includes: a tool mandrel defining a chamber having a port; a power charge disposed in the chamber for emitting a pressurized gas upon ignition; an outer sleeve at least partially surrounding the tool mandrel and defining an annulus between the outer sleeve and the tool mandrel, the annulus being in communication with the port; and a piston disposed in the annulus and having an outer surface facing uphole within the annulus, the piston being in mechanical communication with a setting sleeve of the plug, wherein displacement of the setting sleeve causes setting of a slip and a seal of the plug.

Also disclosed is a method for setting a plug in a borehole penetrating a subsurface formation. The method includes: conveying a plug setting tool coupled to a plug to a selected location in the borehole; igniting a power charge contained in a chamber in a tool mandrel of the plug setting tool to produce a pressurized gas; flowing the pressurized gas through a port in the chamber to an uphole facing outer surface of a piston disposed in an annulus between the tool mandrel and an outer sleeve, the piston being in mechanical communication with a setting sleeve of the plug; and displacing the piston with the pressurized gas to move the setting sleeve and set the plug.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Certain terms to describe direction are defined for use in the following discussion. The term "uphole" relates to the direction from a point of reference in a borehole that leads to the surface. The term "downhole" relates to the direction from a point of reference in a borehole that leads to deeper or further into the borehole.

Disclosed are embodiments of a setting tool and methods for using the same. The tool includes a mandrel that contains a power charge, which when ignited forms a hot pressurized gas. The pressurized gas travels from a void containing the power charge through a hole to an annulus on the uphole side of the sleeve. The annulus is formed by the mandrel, an outer sleeve surrounding the mandrel, and an uphole face of the setting sleeve. The pressurized gas expands in the annulus and pushes on the uphole face. The setting sleeve acts as a piston such that the pressurized gas expands to push the setting sleeve in the downhole direction. Movement of the setting sleeve causes a slip to ride up a conical element and contact a casing lining the wellbore to secure the frac plug in place. Movement of the slip also causes an elastomeric element to expand outward from the frac plug to also make contact with the casing to form a seal.

Figure 1:
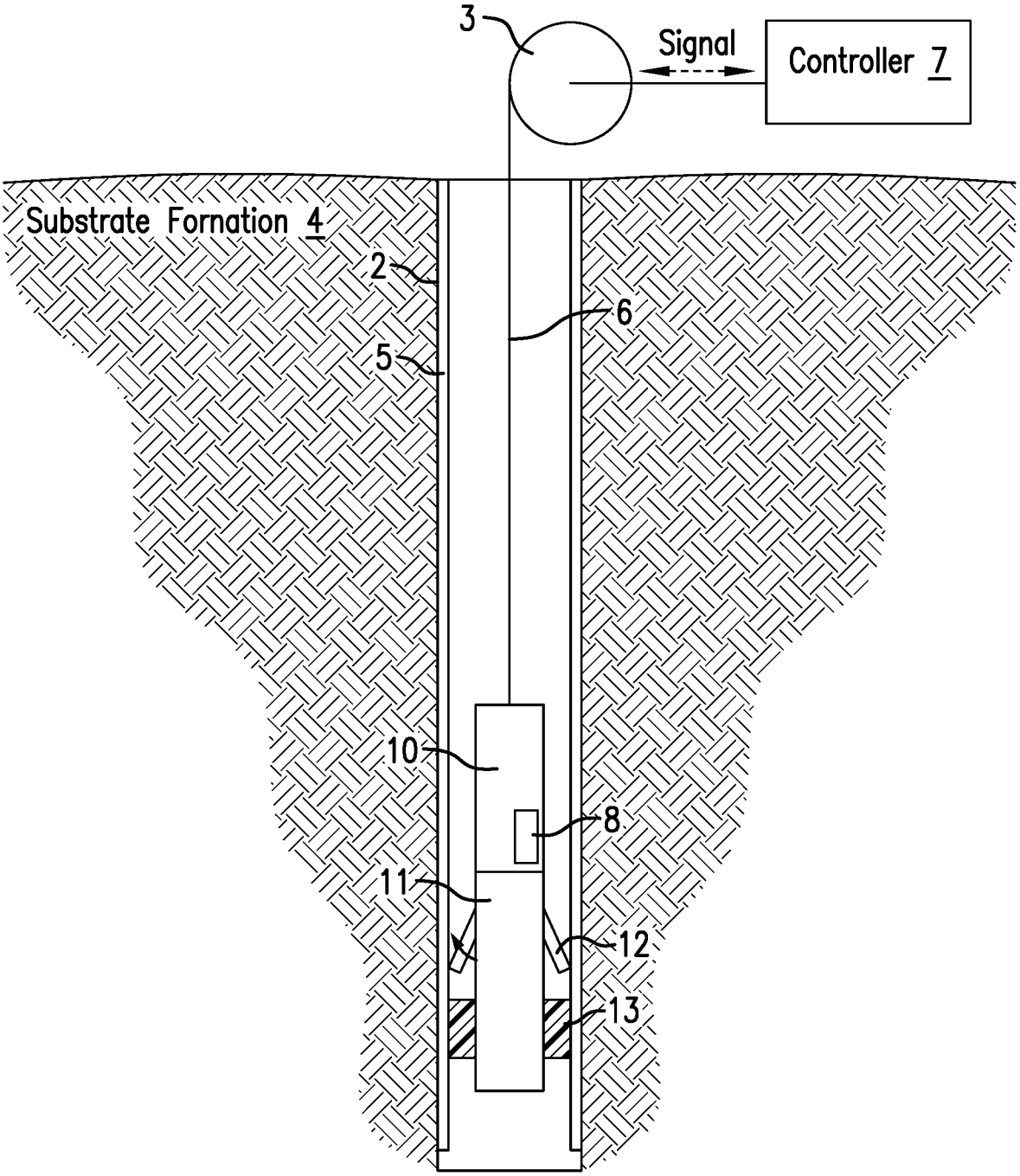
FIG. 1 is a cross-sectional view of an embodiment of a wellbore lined with a casing penetrating a subsurface formation.

FIG. 1 illustrates a cross-sectional view of a borehole 2 penetrating a subsurface formation 4. In hydrocarbon production embodiments, the formation 4 contains a reservoir of hydrocarbons. The borehole 2 is lined with a casing 5. A setting tool 10 coupled to a plug 11 is disposed in the borehole 2. The setting tool 10 and the plug 11 are conveyed to a selected location in the borehole 2 by a carrier 6. Non-limiting embodiments of the carrier 6 include a wireline and a work string having a series of coupled pipes. Other forms of conveyance may also be used. A carrier operator 3 disposed at the surface is configured to operate the carrier 6 in order to convey the setting tool 10 and plug 11 to a selected location. Non-limiting embodiments of the carrier operator 3 include a drill rig or a vehicle having a carrier operating device such as a winch.

The setting tool 10 is configured to be coupled to the plug 11 to convey the plug 11 to the selected location. At the selected location, the setting tool 10 is activated upon receipt of a signal from the surface, generally from a surface controller 7 having a user interface. Non-limiting embodiments of the signal include an electrical signal transmitted via an electrical conductor, an electromagnetic wave signal, an optical signal transmitted via an optical fiber, and an acoustic signal transmitted via a metal work string. Upon activation, the setting tool 10 sets or anchors the plug 11 in place. Setting or anchoring the plug 11 includes moving slips 12 radially outward to contact the casing with sufficient force to anchor the plug in place at the selected location. In addition, a seal 13 is expanded to contact the casing 5 and form a seal in the annulus between an outer diameter of the plug 11 and the casing wall. After the plug 11 is set, a release mechanism, such as shear screws for example, release the plug 11 from the setting tool 10 after exertion of a threshold force so that the setting tool 10 can be removed from the borehole 2. In that the setting tool 10 can be made economically, the setting tool 10 can be disposed after it is used to set the plug 11 and removed from the borehole 2. As such, the setting tool 10 may be regarded as disposable. This alleviates the expense of rebuilding and inspecting the tool after it is used.

The setting tool 10 may also include a sensor 8 for sensing a property of interest or a tool characteristic of interest. For example, the sensor 8 may be configured to sense a location of the setting tool 10 to ensure that the plug 11 is going to be set at a desired location. As another example, the sensor 8 may be configured to sense a status or health of the setting tool 10 to ensure that the setting tool 10 is in the proper condition and ready to be actuated. Sensed data may be transmitted uphole via telemetry to the controller 7 for display to the user. Non-limiting embodiments of the sensor 8 include a position sensor, an imager, a radiation detector, a pressure sensor, a temperature sensor, an acoustic sensor, and a gravity sensor. Telemetry may include electrical cable, optical fiber, or metal work string in non-limiting embodiments.

Figure 2:
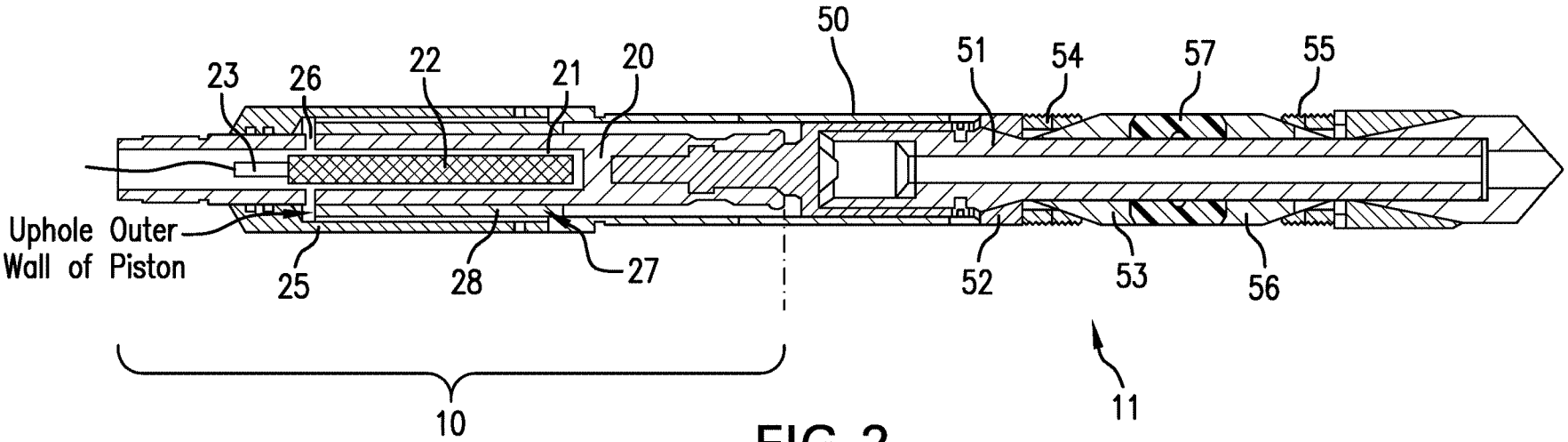
FIG. 2 depicts aspects of a first embodiment of a plug setting tool for setting a plug in the wellbore.

FIG. 2 depicts aspects of a first embodiment of the setting tool 10 in a cross-sectional view in an unactuated state. The setting tool 10 includes a tool mandrel 20 central to the tool 10. The mandrel 20 defines a void or chamber 21 that contains a power charge 22. The power charge 22 is an ignitable material that burns to create a pressurized gas for operating the setting tool 10. In one or more embodiments, the tool mandrel 20 is made of a high strength metal such as steel having sufficient strength and thickness to contain the pressurized gas. The power charge 22 is ignited by a power charge igniter 23. The power charge igniter 23 can be activated electrically by an electric current provided from the controller 7, which can be operated by a user. In that power charges and power charge igniters are known in the art, they are not discussed in further detail.

Still referring to FIG. 2, the setting tool 10 includes an outer sleeve 25 that defines an annulus 27 between the mandrel 20 and the outer sleeve 25. A charge port 26 is defined by the mandrel 20 at the uphole side of the chamber 21 to provide a pathway for the pressurized gas to flow from the chamber 21 into the annulus 27. The term "uphole side" relates to being in a side of the chamber that is at least in the upper half (i.e., towards the surface) of the chamber lengthwise. Disposed in the annulus 27 is a piston 28 having a wall with an outer face facing uphole within the annulus 27. Hence, the pressurized gas entering the annulus 27 via the charge port 26 impinges on the uphole outer-wall side of the piston 28 forcing the piston 28 to move in the downhole direction. In one or more embodiments, the charge port is close to (e.g., within a couple of centimeters) the uphole outer wall side of the piston 28 so that the pressurized gas quickly reaches the piston 28 upon ignition of the power charge 22. Seals (not shown) may be disposed between an outer wall of the piston 28 and an inner wall of the outer sleeve 25 to prevent the pressurized gas from escaping. Similarly, seals (not shown) may be disposed between an inner wall of the piston 28 and an outer wall of the mandrel 20 to further prevent the pressurized gas from escaping.

A downhole side of the piston 28 is in mechanical communication (i.e., either directly or indirectly) with a setting sleeve 50 of the plug 11. The tool mandrel 20 of the setting tool 10 is in mechanical communication with a plug mandrel 51 of the plug 11 such that when the setting tool 10 is activated, the piston 28 pushes the setting sleeve 50 in the downhole direction with respect to the plug mandrel 51. The plug 11 further includes an upper ring 52, an upper conical sleeve 53, and an upper slip assembly 54 which slidably engages with the upper conical sleeve 53 to anchor an upper end of the plug 11 to the casing 5. A lower slip assembly 55 slidably engages a lower conical sleeve 56 to anchor a lower end of the plug 11 to the casing 5. An elastomeric seal element 57 is disposed between the upper conical sleeve 53 and the lower conical sleeve 56 for compressing therebetween to expand and seal between an exterior surface of the plug 15 and the interior surface of the casing 5.

Figure 3:
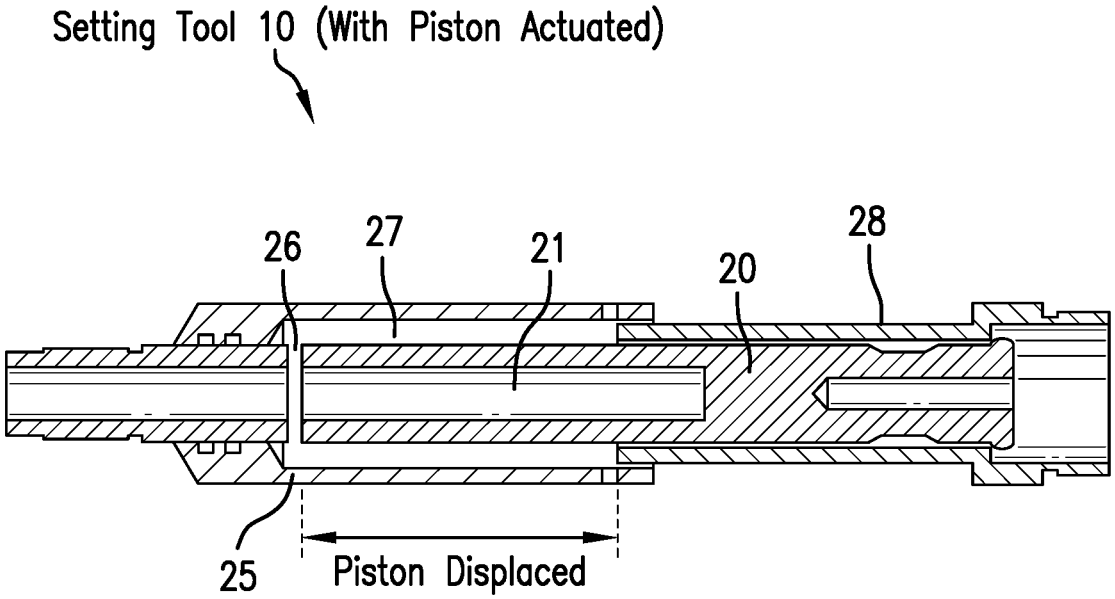
FIG. 3 depicts aspects of the first embodiment of the plug setting tool in an actuated state with a displaced piston.

FIG. 3 depicts aspects of the first embodiment of the setting tool 10 in an actuated state with the piston 28 displaced in the downhole direction.

Figure 4:
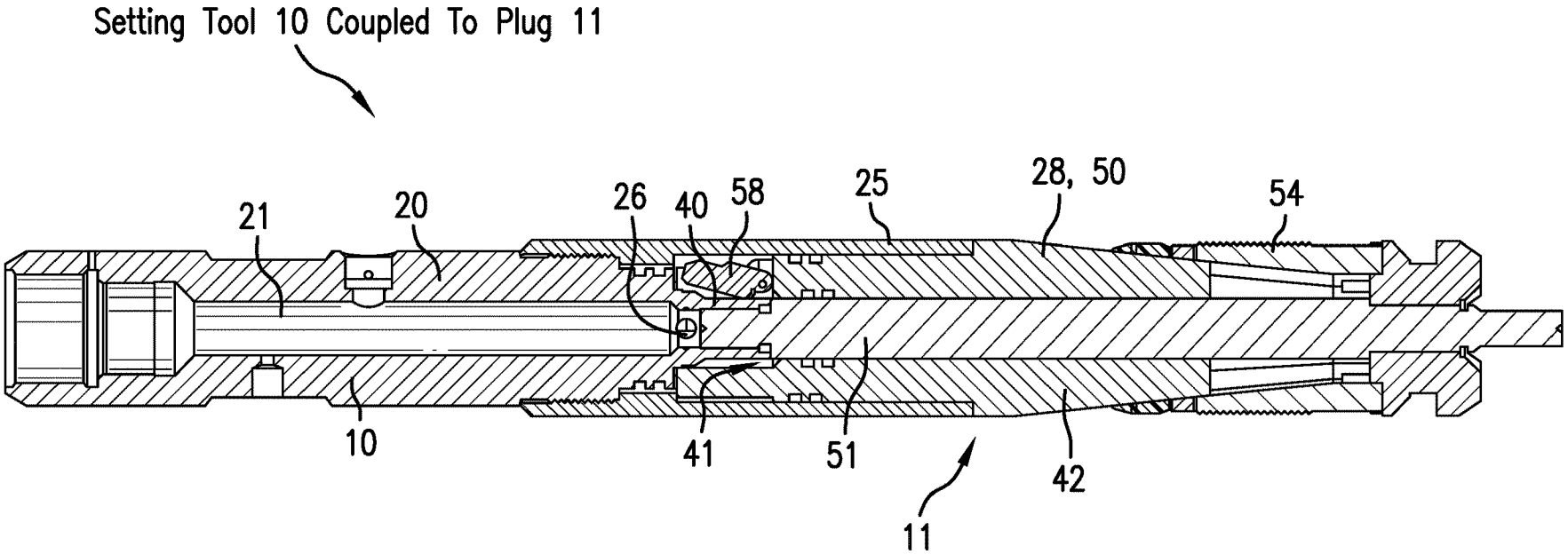
FIG. 4 depicts aspects of a second embodiment of the plug setting tool and the plug.

FIG. 4 depicts aspects of a second embodiment of the setting tool 10 in a cross-sectional view in an unactuated state. In the second embodiment, the piston 28 is also the setting sleeve 50. Hence, piston 28 and the setting sleeve 50 as one component is an integral part of the plug 11 and is referred to as the piston 28/setting sleeve 50. As such, the piston 28/setting sleeve 50 remains with the plug 11 after the plug 11 is set and the setting tool 10 disengages from the plug 11. As illustrated in FIG. 4, at least a portion of the plug 11 is disposed within the annulus 27. In the second embodiment, the charge port 26 is located on the downhole side of the chamber 21. After the power charge 22 is ignited, pressurized gas leaves the chamber 21 through the charge port 26 and enters an annulus void 40 on the uphole outer-side of the piston 28/setting sleeve 50. The pressurized gas impinges on an uphole face 41 of the piston 28/setting sleeve 50 pushing the piston 28/setting sleeve 50 in the downhole direction with respect to the plug mandrel 51. At least a portion of the piston 28/setting sleeve 50 has an inclined or conical surface 42. Hence, as the piston 38/setting sleeve 50 is being pushed in the downhole direction with respect to the plug mandrel 51, the inclined surface 42 forces the upper slip assembly 54 to move in a radially outward direction to make contact with the casing 5, thus setting the plug 11 in place. Similarly, in the embodiment of FIG. 4, the inclined surface 42 also forces a seal ring element 43 to move in a radially outward direction to seal to the interior surface of the casing 5, thus plugging the borehole 2. In one or more embodiments, the plug 11 is frictionally locked together between the conical surface 42 and the upper slip assembly 54.

Figure 5:
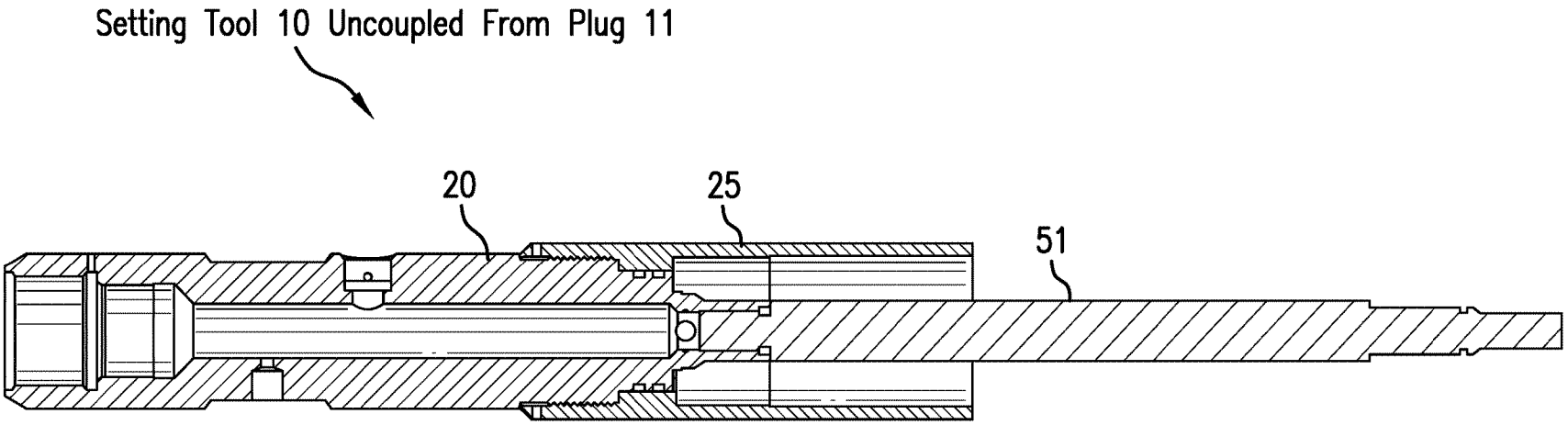
FIG. 5 depicts aspects of the plug setting tool in the second embodiment with the plug setting tool uncoupled from the plug.
Figure 6:
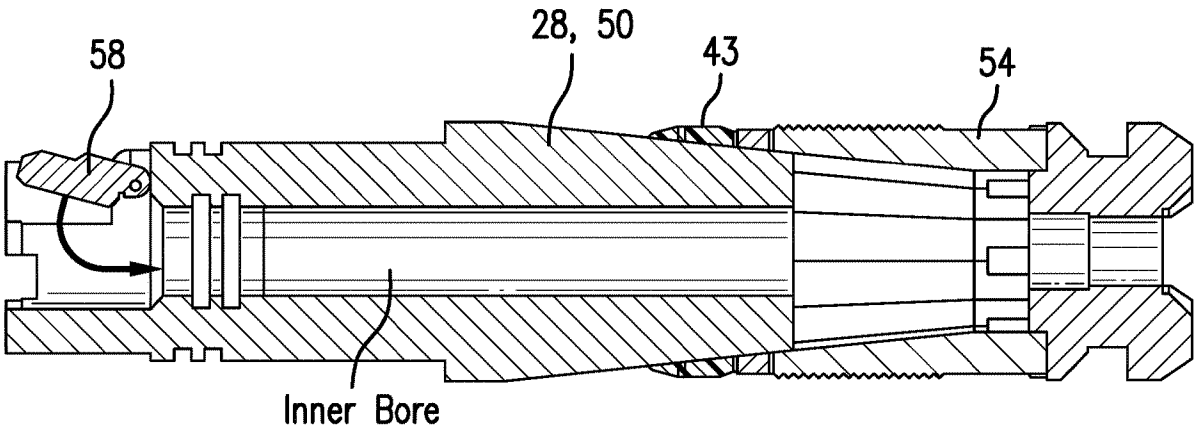
FIG. 6 depicts aspects of the plug in the second embodiment uncoupled from the plug setting tool.

In the second embodiment, once the plug 11 is set and the borehole 2 plugged, then the setting tool 10 with the plug mandrel 51 still attached is removed from the borehole 2. FIG. 5 illustrates the second embodiment of the setting tool 10 with the plug mandrel 51 attached for removal from the borehole 2. FIG. 6 illustrates the second embodiment of the plug 11 with the plug mandrel 51 removed.

Also illustrated in FIG. 4 is a check valve 58, which in one or more embodiments can be a flapper element. Once the plug 11 is set in place, the plug mandrel 51 is removed along with the setting tool 10 as the setting tool 10 is extracted to the surface and the check valve 58 can close upon passing of the plug mandrel 51 under the influence of a torsion spring or fluid flow to seal off the inner bore of the plug 11. In the embodiment where the check valve 58 includes a flapper element, the flapper element rotates into the entrance of the inner bore and seals against a lip of the entrance.

Figure 7:
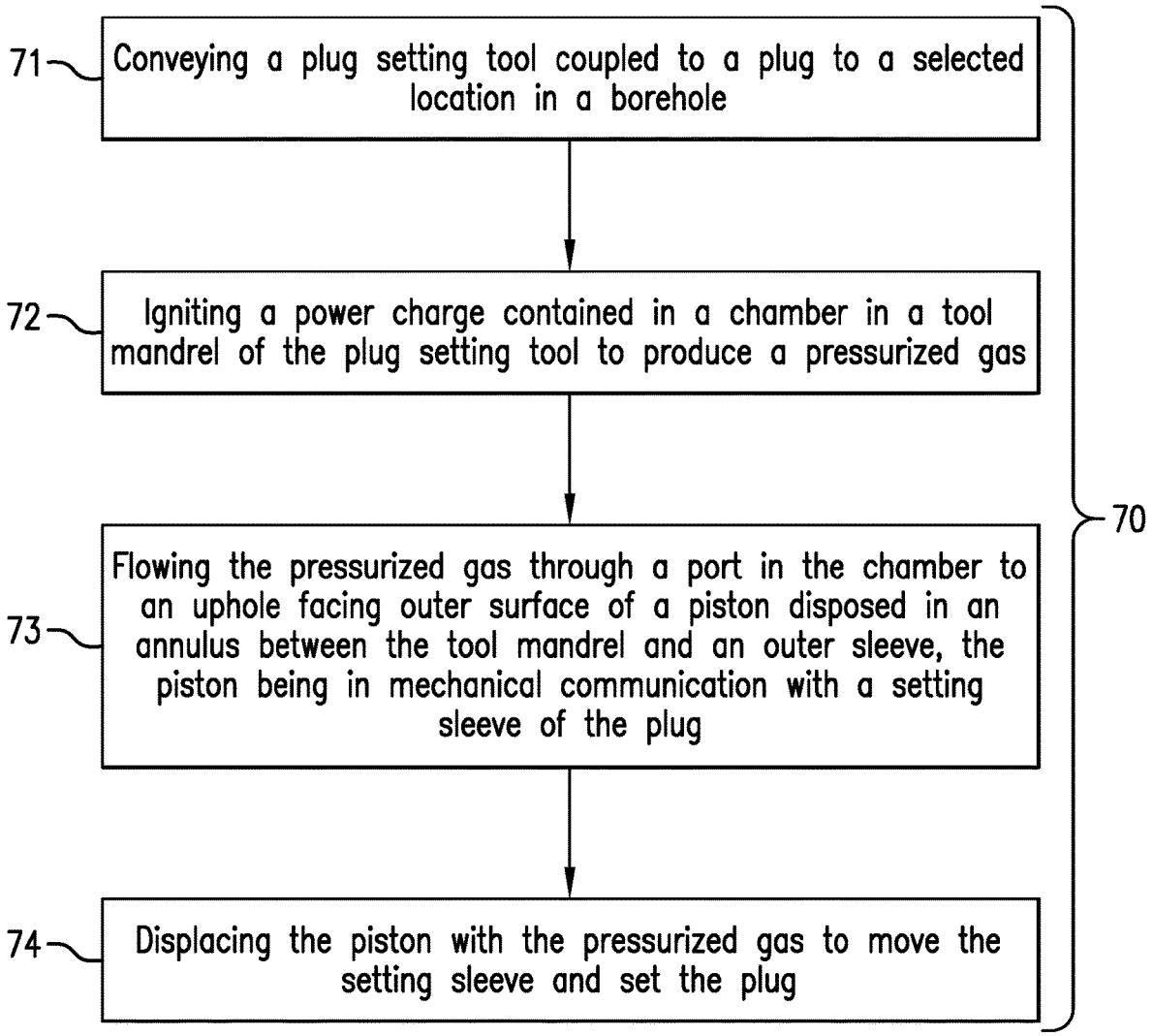
FIG. 7 is a flow chart for a method for installing the plug in the wellbore.

FIG. 7 is a flow chart for a method 70 for setting a plug in a borehole. Block 71 calls for conveying a plug setting tool coupled to a plug to a selected location in the borehole. Block 72 calls for igniting a power charge contained in a chamber in a tool mandrel of the plug setting tool to produce a pressurized gas. Block 73 calls for flowing the pressurized gas through a port in the chamber to an uphole facing outer surface of a piston (i.e., on the outside of the piston) disposed in an annulus between the tool mandrel and an outer sleeve, the piston being in mechanical communication with a setting sleeve of the plug. In one or more embodiments, the charge port is in an uphole side of the chamber. In one or more embodiments, the piston and setting sleeve are one component of the plug and the charge port is in a downhole side of the chamber. In one or more embodiments, the tool mandrel and chamber are cylindrically shaped. In one or more embodiments, the piston is a barrel piston with a wall thickness configured to fit within the confines of the annulus. Block 74 calls for displacing the piston with the pressurized gas to move the setting sleeve and set the plug. In one or more embodiments, the piston is displaced in a downhole direction.

In one or more embodiments, the plug includes one or more slips that are forced radially outward to engage a casing lining the borehole by movement of the setting sleeve. In one or more embodiments, the plug includes a seal that expands to seal against an inner wall of a casing lining the borehole.

The method 70 may also include uncoupling the plug from the setting tool in response to setting the plug. In embodiments where the piston and setting sleeve are one component of the plug, after the plug is disengaged from the setting tool the piston/setting sleeve component remains with the plug and the plug mandrel is removed with the setting tool. Non-limiting embodiments of uncoupling may include shearing shear screws base on applying a force exceeding the shear force capacity of the shear screws.

The disclosure herein provides several advantages. One advantage is that the piston by being disposed in the annulus is protected from impingement of debris that is in the borehole. Another advantage is that the piston is less prone if not immune to plugging between the piston and the mandrel that would prevent displacement of the piston. An advantage of the piston being integrated with the setting sleeve is that less components may be used thus decreasing the cost of the setting tool and enabling it to be disposable.

Set forth below are some embodiments of the foregoing disclosure:

Embodiment 1: An apparatus for setting a plug in a borehole penetrating a subsurface formation, the apparatus comprising a tool mandrel defining a chamber having a port, a power charge disposed in the chamber for emitting a pressurized gas upon ignition, an outer sleeve at least partially surrounding the tool mandrel and defining an annulus between the outer sleeve and the tool mandrel, the annulus being in communication with the port, and a piston disposed in the annulus and having an outer surface facing uphole within the annulus, the piston being in mechanical communication with a setting sleeve of the plug, wherein displacement of the setting sleeve causes setting of a slip and a seal of the plug.

Embodiment 2: The apparatus as in any prior embodiment wherein the port is located halfway or greater lengthwise on an uphole side of the chamber.

Embodiment 3: The apparatus as in any prior embodiment wherein the location of the port is at an uphole end of the chamber.

Embodiment 4: The apparatus as in any prior embodiment further comprising an igniter proximate to the power charge.

Embodiment 5: The apparatus as in any prior embodiment wherein the igniter is in operable communication with a surface controller.

Embodiment 6: The apparatus as in any prior embodiment further comprising a sensor disposed on the apparatus.

Embodiment 7: The apparatus as in any prior embodiment wherein the sensor comprises at least one of a position sensor, an imager, a radiation detector, a pressure sensor, a temperature sensor, an acoustic sensor, and a gravity sensor.

Embodiment 8: The apparatus as in any prior embodiment wherein the piston is integrated with the setting sleeve as one component, the piston and setting sleeve being disconnectable from the tool mandrel such that the piston and setting sleeve when disconnected from the tool mandrel remain with the plug.

Embodiment 9: The apparatus as in any prior embodiment wherein the port is located at a downhole end of the chamber.

Embodiment 10: The apparatus as in any prior embodiment further comprising a check valve configured to seal an inner bore of the plug.

Embodiment 11: A method for setting a plug in a borehole penetrating a subsurface formation, the method comprising conveying a plug setting tool coupled to a plug to a selected location in the borehole, igniting a power charge contained in a chamber in a tool mandrel of the plug setting tool to produce a pressurized gas, flowing the pressurized gas through a port in the chamber to an uphole facing outer surface of a piston disposed in an annulus between the tool mandrel and an outer sleeve, the piston being in mechanical communication with a setting sleeve of the plug, and displacing the piston with the pressurized gas to move the setting sleeve and set the plug.

Embodiment 12: The method as in any prior embodiment wherein flowing the pressurized gas through a port in the chamber comprises flowing the pressurized gas through a port located at an uphole end of the chamber.

Embodiment 13: The method as in any prior embodiment further comprising separating the plug from the plug setting tool.

Embodiment 14: The method as in any prior embodiment wherein piston and the setting sleeve are one component and the method further comprises separating the piston and setting sleeve from the plug setting tool such that the piston and setting sleeve when separated from the plug setting tool remain with the plug.

Embodiment 15: The method as in any prior embodiment further comprising sealing an inner bore of the plug using a check valve.

Embodiment 16: The method as in any prior embodiment wherein flowing the pressurized gas through a port in the chamber comprises flowing the pressurized gas through a port located at a downhole end of the chamber.

Embodiment 17: The method as in any prior embodiment further comprising transmitting a signal from a controller to a power charge igniter in operable communication with the power charge to ignite the power charge.

Embodiment 18: The method as in any prior embodiment further comprising sensing a parameter using a sensor disposed in the plug setting tool and transmitting sensed data to a surface device.

Embodiment 19: The method as in any prior embodiment wherein the parameter is correlated to at least one of the selected location and a health of the plus setting tool and/or the plug.

In support of the teachings herein, various analysis components may be used, including a digital and/or an analog system. For example, the surface controller 7 and/or the sensor 8 may include digital and/or analog systems. The system may have components such as a processor, storage media, memory, input, output, communications link (wired, wireless, optical or other), user interfaces (e.g., a display or printer), software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply, magnet, electromagnet, sensor, electrode, transmitter, receiver, transceiver, antenna, controller, optical unit or components, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured.

The flow diagram depicted herein is just an example. There may be many variations to this diagram or the steps (or operations) described therein without departing from the scope of the invention. For example, operations may be performed in another order or other operations may be performed at certain points without changing the specific disclosed sequence of operations with respect to each other. All of these variations are considered a part of the claimed invention.

The disclosure illustratively disclosed herein may be practiced in the absence of any element which is not specifically disclosed herein.

While one or more embodiments have been shown and described, modifications and substitutions may be made thereto without departing from the scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for setting a plug in a borehole penetrating a subsurface formation, the apparatus comprising:

a tool mandrel defining a chamber having a port;

a power charge disposed in the chamber for emitting a pressurized gas upon ignition;

an outer sleeve at least partially surrounding the tool mandrel and defining an annulus between the outer sleeve and the tool mandrel, the annulus being in communication with the port; and a piston disposed in the annulus and configured to be displaced in the annulus upon ignition of the power charge, the piston having an outer surface facing uphole within the annulus, the piston being in mechanical communication with a setting sleeve of the plug, wherein displacement of the setting sleeve causes setting of a slip and a seal of the plug.

2. The apparatus according to claim 1, wherein the port is located halfway or greater lengthwise on an uphole side of the chamber.

3. The apparatus according to claim 2, wherein the location of the port is at an uphole end of the chamber.

4. The apparatus according to claim 1, further comprising an igniter proximate to the power charge.

5. The apparatus according to claim 4, wherein the igniter is in operable communication with a surface controller.

6. The apparatus according to claim 1, further comprising a position sensor disposed on the apparatus and configured to sense a characteristic of the apparatus related to the apparatus being ready to be actuated.

7. The apparatus according to claim 1, further comprising a sensor comprising at least one of an imager, a radiation detector, a pressure sensor, a temperature sensor, an acoustic sensor, and a gravity sensor.

8. The apparatus according to claim 1, wherein the piston is integrated with the setting sleeve as one component, the piston and setting sleeve being disconnectable from the tool mandrel such that the piston and setting sleeve when disconnected from the tool mandrel remain with the plug.

9. The apparatus according to claim 8, wherein the port is located at a downhole end of the chamber.

10. The apparatus according to claim 8, further comprising a check valve configured to seal an inner bore of the plug.

11. A method for setting a plug in a borehole penetrating a subsurface formation, the method comprising:

conveying a plug setting tool coupled to a plug to a selected location in the borehole;

igniting a power charge contained in a chamber in a tool mandrel of the plug setting tool to produce a pressurized gas;

flowing the pressurized gas through a port in the chamber to an uphole facing outer surface of a piston disposed in an annulus between the tool mandrel and an outer sleeve, the piston being in mechanical communication with a setting sleeve of the plug; and displacing the piston in the annulus with the pressurized gas to move the setting sleeve and set the plug.

12. The method according to claim 11, wherein flowing the pressurized gas through a port in the chamber comprises flowing the pressurized gas through the port located at an uphole end of the chamber.

13. The method according to claim 11, further comprising separating the plug from the plug setting tool.

14. The method according to claim 13, wherein piston and the setting sleeve are one component and the method further comprises separating the piston and setting sleeve from the plug setting tool such that the piston and setting sleeve when separated from the plug setting tool remain with the plug.

15. The method according to claim 14, further comprising sealing an inner bore of the plug using a check valve.

16. The method according to claim 11, wherein flowing the pressurized gas through a port in the chamber comprises flowing the pressurized gas through the port located at a downhole end of the chamber.

17. The method according to claim 11, further comprising transmitting a signal from a controller to a power charge igniter in operable communication with the power charge to ignite the power charge.

18. The method according to claim 11, further comprising sensing a tool characteristic related to the plug setting tool being ready to be actuated using a position sensor disposed in the plug setting tool to provide sensed data and transmitting the sensed data to a surface device.

19. The method according to claim 11, further comprising sensing a parameter that is correlated to at least one of a selected location and a health of the plug setting tool and/or the plug using a sensor disposed in the plug setting tool.

20. The method according to claim 11, further comprising removing the plug setting tool from the borehole after the plug setting tool sets the plug and disposing the plug setting tool.

* * * * *